United States Patent [19]

Detterman et al.

[11] 4,408,780

[45] Oct. 11, 1983

[54] BOUND BOOK AND METHOD OF MAKING SUCH BOOKS

[75] Inventors: Don E. Detterman; Ronald S. Danhoff, both of Willard; William E. Wheeler, Plymouth, all of Ohio

[73] Assignee: R. R. Donnelley & Sons Company, Chicago, Ill.

[21] Appl. No.: 256,552

[22] Filed: Apr. 22, 1981

[51] Int. Cl.[3] ..... B42D 1/00; B42C 9/00

[52] U.S. Cl. ..... 281/15 R; 281/21 R; 412/6

[58] Field of Search ..... 412/8, 29, 33, 38, 16, 412/36, 37, 6; 281/23, 29 R, 15 R, 21 R

[56] References Cited

U.S. PATENT DOCUMENTS

| | | | |
|---|---|---|---|
| 1,973,375 | 9/1934 | Frazier | 281/26 |
| 1,976,845 | 10/1934 | Frazier | 281/26 |
| 2,551,555 | 5/1951 | Boyajian | 281/21 |
| 2,644,965 | 7/1953 | Kitcat | 412/29 |
| 3,956,057 | 5/1976 | Jung | 412/37 X |
| 4,106,148 | 8/1978 | Axelrod | 412/8 |
| 4,213,220 | 7/1980 | Lopez-Martinex | 412/8 |

FOREIGN PATENT DOCUMENTS

| | | |
|---|---|---|
| 441401 | 1/1936 | United Kingdom . |
| 713098 | 8/1954 | United Kingdom . |
| 1415390 | 11/1975 | United Kingdom . |
| 1519170 | 7/1978 | United Kingdom . |

OTHER PUBLICATIONS

Comstock & Wescott, Inc., "Saws and Roughers for Adhesive Binding", (Publication date unknown).

Comstock & Wescott, Inc., "Comstock and Wescott Precision Cutters for Book Binding", (Publication date unknown).

Comstock & Westcott, Inc., "The C & W Rake Rougher", (Publication date unknown).

*Primary Examiner*—Paul A. Bell
*Assistant Examiner*—John S. Brown
*Attorney, Agent, or Firm*—Wood, Dalton, Phillips, Mason & Rowe

[57] ABSTRACT

An improved book which is bound ready to be covered or cased consists of a pack of signatures plus front and back end sheets, with the signatures closed along the spine and a multiplicity of closely spaced, wide open notches penetrating the entire spine and all the closed sides of sheets in the pack to greatly enlarge the area of the spine to which adhesive may be applied. A wrap-around coating of adhesive covers the surfaces of the notches, the spine between the notches, and the faces of the end sheets between the notches.

The book is made in high speed commercial perfect binding equipment which is modified by substituting a notch cutter for the roughing cutter, adding pinch rolls downstream from the notch cutter, and adding apparatus to apply metered quantities of hot melt adhesive in a first coat consisting of thin strips along the notched faces of the end sheets and extending into the notches, so that when a second conventional coat of hot melt adhesive is applied to the notched spine by a roller, the second coat may amalgamate with the first coat in the notches.

19 Claims, 15 Drawing Figures

BOUND BOOK AND METHOD OF MAKING SUCH BOOKS

BACKGROUND OF THE INVENTION

Perfect binding is very popular because it is much faster and less expensive than side sewing or spine sewing, and it can be used to manufacture books which are too thick for saddle stitching. However, conventional perfect binding has the disadvantage that the pages are not held at the spine with the strength of sewn books. This, therefore, limits the categories of books to which perfect binding may be applied.

Children's books are a very specialized category because they must be capable of standing up to rough handling; so publishers of such books have generally considered it necessary to have them sewn for strength. This, however, adds greatly to the cost of such books and correspondingly limits the market for them.

Accordingly, a need has existed for many years for a method of binding books which is capable of producing books comparable in binding strength to books with sewn bindings but at about the cost of perfect binding. The need has, of course, become more acute as the cost of book manufacture increases; and for several years the cost of sewn, case-bound books has indicated such a need in a broad range of books.

SUMMARY OF THE INVENTION

In accordance with the present invention, a book which is bound and ready to be covered or cased comprises a pack of signatures at least some of which comprise a plurality of interleaved sheets, each signature having a closed side along the spine, and said pack having its entire spine and all the closed sides of sheets in each signature penetrated by a multiplicity of closely spaced, wide open notches which greatly enlarge the area of the spine to which adhesive may be applied. A wrap-around coating of adhesive covers the entire spine area including the faces of the notches, the spine between the notches, and the front and back surfaces of the pack between the notches.

In a preferred embodiment, front and back end sheets form part of the notched pack, and the wrap-around coating of adhesive consists of thin coats which are on the end sheets and extend into the notches to bind the end sheets to the signatures, and a thick coat which is on the faces of the notches and the spine between the notches, with the thin and thick coats being amalgamated in and around the notches. A most preferred embodiment has a wrap-around coating of hot melt adhesive.

The books may be bound in high speed commercial perfect binding equipment which is modified to carry out the method of the invention. The method carried out by the modified equipment forms a multiplicity of closely spaced, wide open notches in the spine of a clamped pack of signatures which penetrate the entire spine and all the closed sides of sheets in each signature, after which the lower marginal portion of the pack in which the notches have been formed is passed between nipping rolls. Thin strips of adhesive are then simultaneously applied to each of the front and back faces of the pack of signatures in such a way that some of the adhesive extends into the notches, and then an excess of adhesive is applied to the spine in such a way that it coats the entire spine and the faces of the notches and amalgamates with the adhesive of the thin strips and around the notches.

Production of the preferred book requires, of course, that the end sheets be part of the pack, so that the thin strips of adhesives are applied to the end sheets and the adhesive that extends into the notches binds the end sheets to the signatures in a very effective manner.

THE DRAWINGS

DETAILED DESCRIPTION

I. The Book

Figures 1, 2, 3, 4, 5, 6, 7:
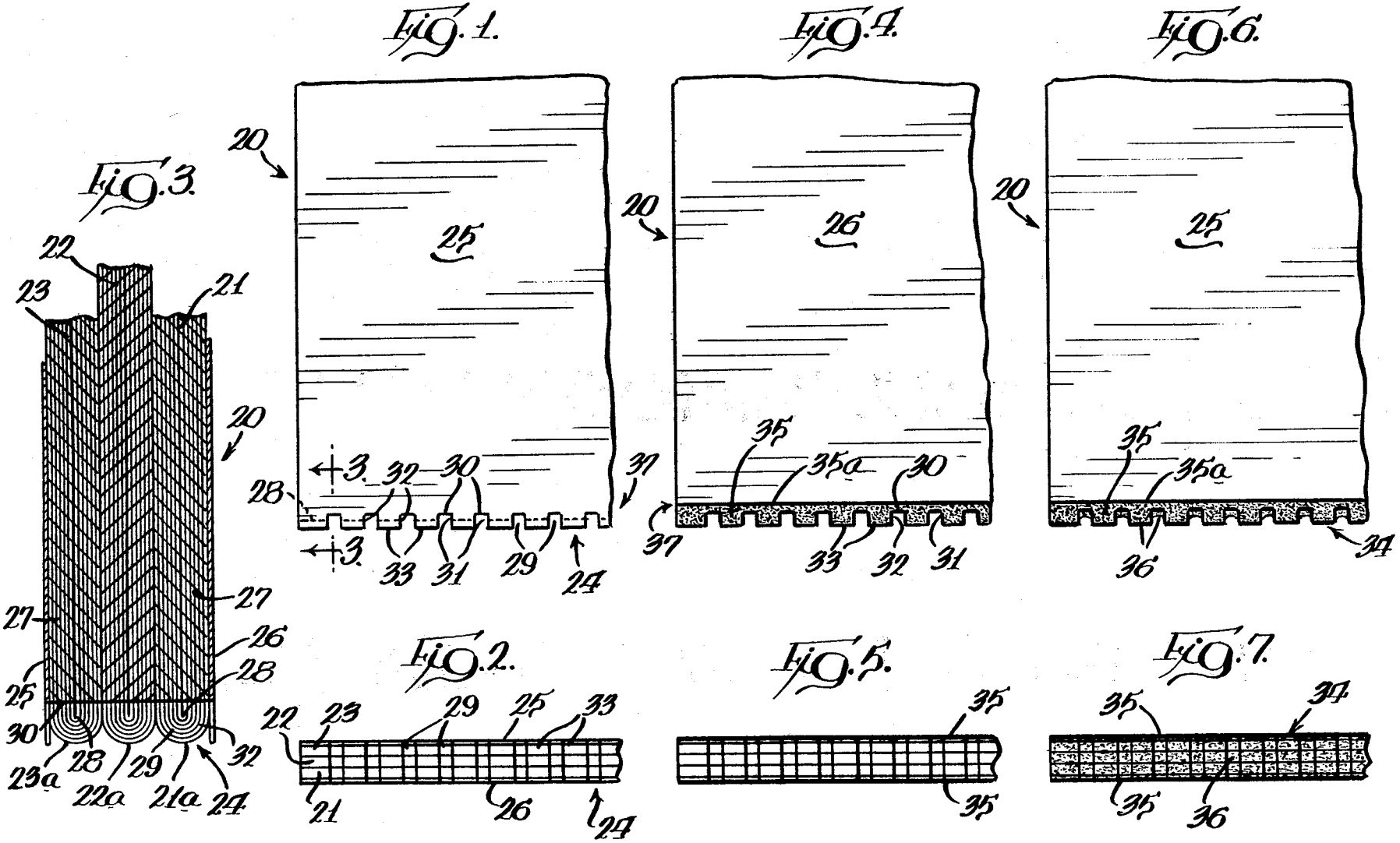
FIG. 1 is a fragmentary front plan view of a pack of notches signatures and end sheets prior to application of adhesive.
FIG. 2 is an elevational view of the spine of the pack of sheets and signatures seen in FIG. 1.
FIG. 3 is a greatly enlarged, fragmentary sectional view taken substantially as illustrated along the line 3—3 of FIG. 1.
FIG. 4 is a back plan view of the pack of signatures and end sheets with the thin first coats of adhesive applied thereto.
FIG. 5 is an elevational view of the spine of the pack of signatures and end sheets with thin first coats of adhesive applied thereto, taken as though viewing FIG. 4 from below.
FIG. 6 is a front plan view of the completed book ready for binding.
FIG. 7 is an elevational view of the spine of the completed book ready for binding, taken as though viewing FIG. 6 from below.

Referring to the drawings in detail, and referring first to FIGS. 1 to 7, the book of the present invention, which is bound and ready to be cased, consists of a pack 20 that may contain any desired number of signatures, and which is here illustrated as consisting of three signatures 21, 22 and 23 which have respective closed sides 21*a*, 22*a* and 23*a* along a spine 24 of the pack. In addition to the signatures, the pack includes a front end sheet 25 and a back end sheet 26.

Just as the book may consist of any desired number of signatures, each signature may consist of any desired number of pages; but the signatures are illustrated in FIG. 3 as consisting of twelve sheets—i.e., twenty-four pages, and this means necessarily that at the closed side of each signature the fold 28 of the innermost sheet 27 is offset from the spine 24; and in a large signature having, for example, 64 pages, the offset of the fold in the innermost signature is considerably greater.

The spine 24 of the pack of signatures is penetrated by a multiplicity of closely spaced notches 29, each of which extends completely through the end sheets 25 and 26 and though all the closed sides of the signatures in the pack so that the edges of all the sheets in the signatures are exposed along the top faces 30 of the notches and along the right-hand faces 31 and the left-hand faces 32 of the notches. The notches are formed by cutters, as will be described in more detail in connection with the apparatus, and the cutting of the notches tends to cause at least a small amount of binding of the cut edges of the sheets in the signatures and in the end sheets; but at the same time the notches have very clean, straight faces. The width of the notches may be anywhere between about 1/16" and 5/32" (1.6 to 4 mm), and the depth of the notches is sufficient that they penetrate a considerable distance through the closed sides of all the signatures. Typically the depth is about ⅛" (3.175 mm). The space 33 between the notches is typically about 5/16" (7.9375 mm), but this varies with the width of the notches 29 for reasons that will be described.

For purposes of relating the packs 20 to the method of manufacture, the right-hand notch faces 31 may be considered as upstream faces and the faces 32 are downstream faces. The drawings show plainly that the notches greatly enlarge the area of the spine to which adhesive may be applied, and have square corners.

As seen in FIGS. 6 and 7, when the pack 20 of signatures is bound to provide a book which is ready to be cased, a wrap-around coating 34 of hot melt adhesive covers the entire spine area including the faces 30, 31 and 32 of the notches, the areas 33 of the spine between the notches and the faces of the end sheets 25 and 26 to a line somewhat above the top faces 30 of the notches. The wrap-around coating is applied in successive operations, after the first of which the pack 20 of signatures appears generally as illustrated in FIGS. 4 and 5. Specifically, in the first step, thin coats 35 of hot melt adhesive are applied in strips along the notched surfaces of the end sheets 25 and 26, and when the coats 35 are applied some of the adhesive extends into the notches along the faces 30, 31 and 32, and principally along the downstream faces 32; and this adhesive partially binds the end sheets 25 and 26 to the notched edges of at least some of the signatures in the pack. As will be described in detail, the apparatus and method used to apply the thin coats 35 inherently causes them to have thick beads 35*a* of adhesive along their upper edges. In addition, typically there are strings of adhesive hanging down from the adhesive coats 35.

After the thin coats 35 of adhesive are applied to the end sheets 25 and 26, a thick coat 36 of hot melt adhesive is applied to the spine 24 by a roller, and the spine coat 36 picks up the dangling strings of adhesive from the coats 35 and also extends into the notches 29. The thin coats 35 and the thick coat 36 are thus amalgamated in and around the notches, so the finished wrap-around coating 34 is quite homogeneous.

In certain conditions it may be desirable to remove the closed sides of the outermost sheets in a thick signature, leaving only the closed sides of the more inward sheets to be notched.

II. The Method of Making the Book and the Apparatus for Carrying Out the Method

As previously indicated, the books may be bound in high speed commercial perfect binding equipment which is modified to carry out the method of the invention. Accordingly, the apparatus is described only to the extent necessary to identify the steps in the method and to permit one skilled in the art to carry out the necessary modifications of the equipment.

The method of the invention is preferably carried out with collating and perfect binding equipment of the type in which the ends sheets 25 and 26 are carried in the binder carrier clamps with the signatures, so that the wrap-around adhesive coating 34 firmly binds the end sheets to the signatures in the book. However, even if the end sheets must be tipped onto the book after the pack of signatures has the wrap-around adhesive coating, the book is stronger than a conventional perfect-bound book.

Figure 8:
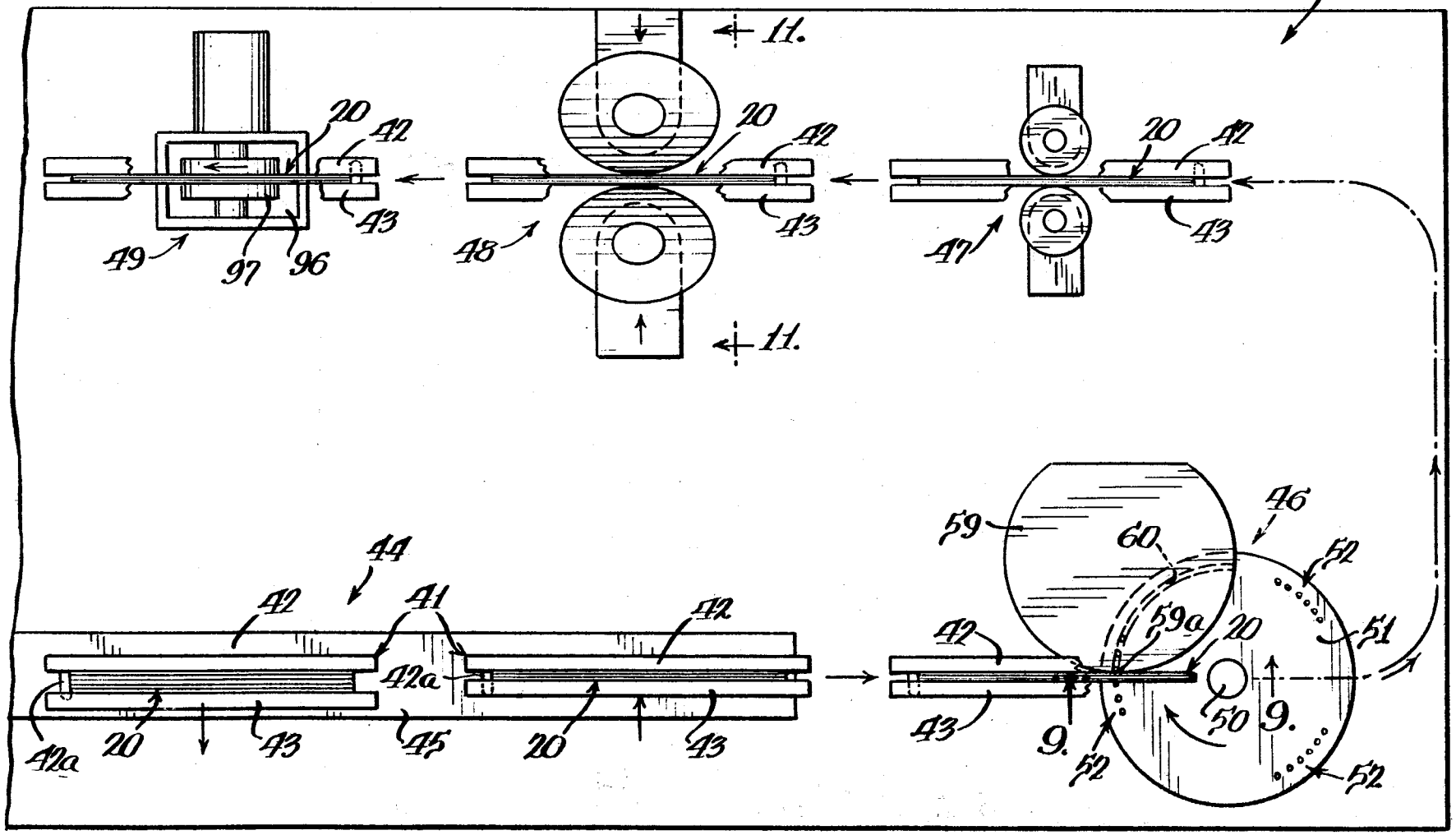
FIG. 8 is a diagrammatic view illustrating the several steps in the high speed, continuous process of making books in accordance with the present invention.

Referring now particularly to FIG. 8, a perfect binding machine is illustrated diagrammatically and indicated generally by the reference numeral 40. The machine includes a frame which carries an endless array of clamps 41, each of which consists of a fixed back plate 42 against which a pack of signatures is clamped by a movable front plate 43.

At a first station 44 there is a leveling table 45 upon which successive packs 20 of signatures are supported with the clamps 41 loose and the packs being pushed by pins 42*a* at the trailing ends of the clamps which bear upon closed trailing ends of the signatures. The spine 24 of the pack 20 is at the bottom, so that all the parts of the pack are level along the spine, and the front plate 43 then clamps the pack against the back plate 42 so the pack is held with its lower marginal portion 37 below the clamp plates in the conventional manner as seen in FIG. 9.

From the leveling station 44 the clamps carry the packs of signatures successively through a notching station, indicated generally at 46; then through nipping rollers, indicated generally at 47; then through a side coat applying station, indicated generally at 48; and finally through a spine coat applying station, indicated generally at 49. Only the components of the notching station 46 and of the side coat applying station 48 differ from conventional patent binding systems, so only those stations will be described in detail.

Figure 10:
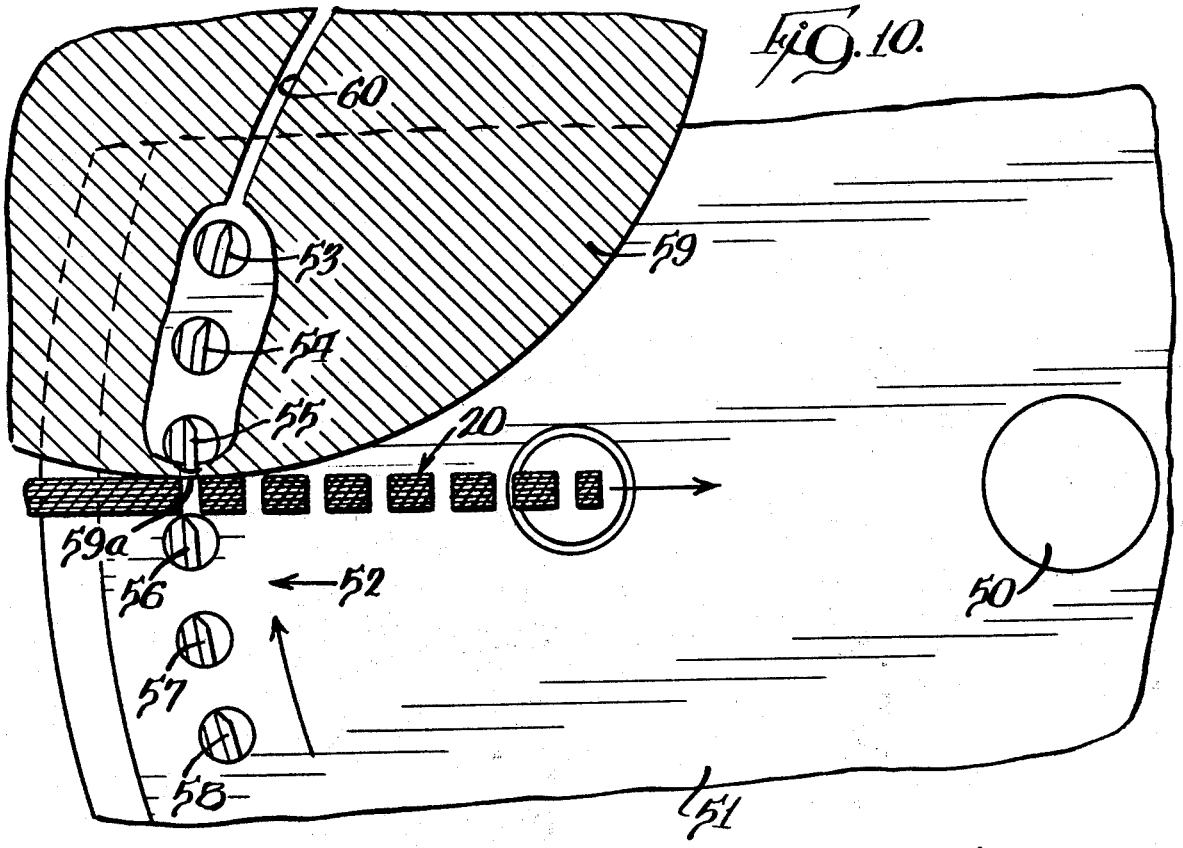
FIG. 10 is a fragmentary sectional view taken substantially as indicated along the line of 10—10 of FIG. 9.
Figure 9:
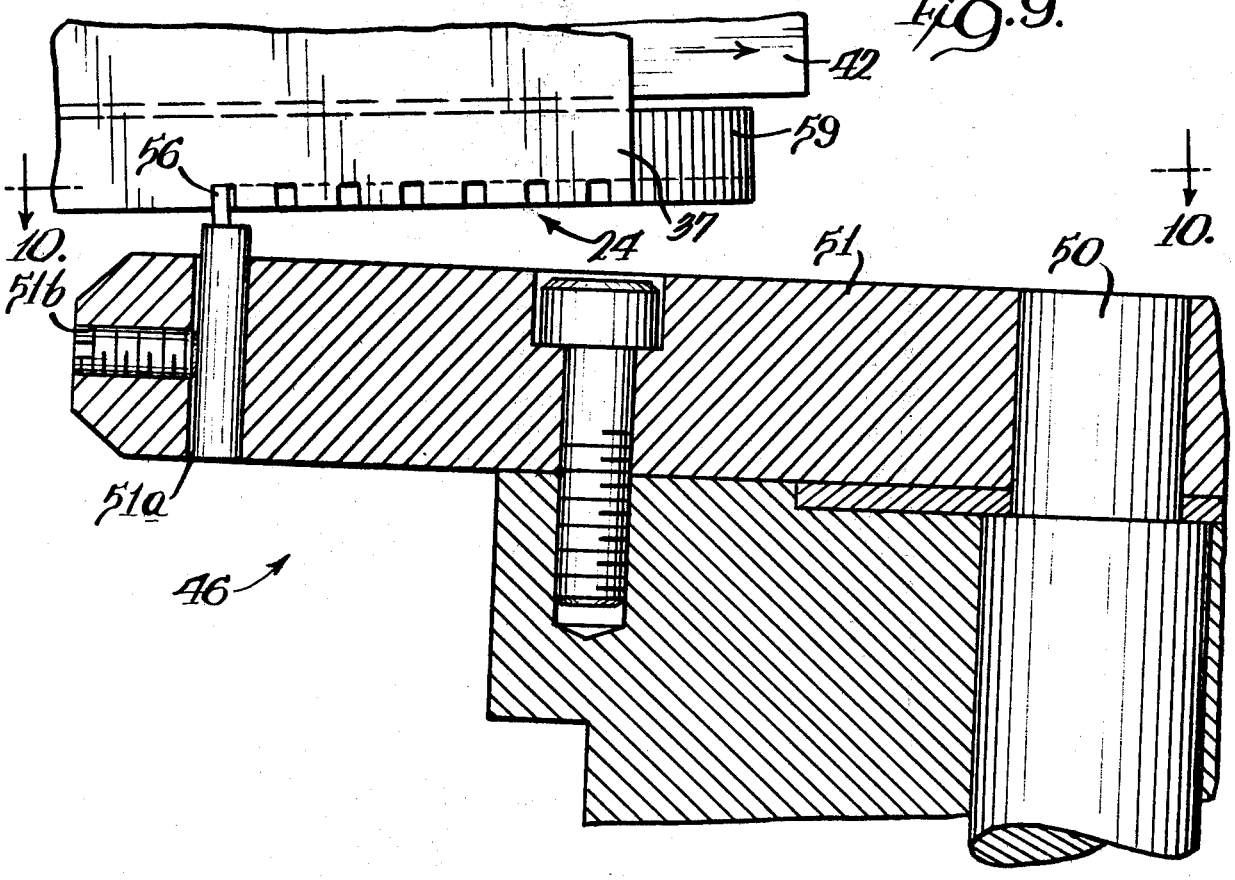
FIG. 9 is a fragmentary sectional view on an enlarged scale taken substantially as indicated along the line 9—9 of FIG. 8.

Referring now particularly to FIG. 9, a shaft 50 is like that of a conventional roughing cutter of a perfect binding machine, and is placed at a small angle to the vertical. Fixed on the upper end of the shaft 50 is a notcher plate 51 which is seen in FIG. 8 to be provided with three sets 52 of notching blades which extend upwardly from the plate 51, and the sets are evenly spaced about the periphery of the plate. Each set of notching blades is best seen in FIG. 10 to consist of an opener blade 53, followed by a leading side cutter blade 54, a trailing side cutter blade 55, and three finishing blades 56, 57 and 58.

Behind the notcher plate 51 is a fixed backup plate 59 which is circular and has a tangent area 59*a* in contact with the back surface of the signature pack 20 immediately below the back plates 42 of the clamps. The notching blades run in an arcuate slot 60 which is in the bottom surface of the backup plate 59, so the entire lower marginal portion 37 of the signature pack is supported immediately adjacent the notching blades. Conveniently, the backup plate 59 is fabricated from relatively soft metal, such as cold finished Muntz metal, or from a phenolic resin and vegetable fibre material, so the arcuate slot 60 may be cut in the backup plate by the notching blades themselves before the notcher is put into operation. The angle of the shaft 50 to the vertical is just enough that the sets 52 of notching blades at the downstream side of the plate 51 clear the spines 24 of the packs 20.

A conventional rougher is driven by a motor which is separate from the drive for the binding machine 40, and in the present apparatus an independent motor drive is also used to rotate the notcher shaft 50. In the present apparatus, however, it is essential that the rate of rotation of the shaft 50 be precisely coordinated with the speed at which the array of binding machine clamps 41 travels, since it is the forward travel of the packs 20, coordinated with the space between the sets 52 of notching blades, that produces the multiplicity of spaced notches 29 in the spine 24 of each pack. Any acceptable type of slave control may be used to coordinate the rate of rotation of the notcher shaft 50 with the speed of the binding machine drive.

For easy replacement, each of the notching blades 53–58 may be mounted in a socket 51*a* in the notcher plate 51 and locked in place by a set screw 51*b* which is in a threaded hole in the upright peripheral side surface of the notcher plate.

The notched packs 20 are next carried through conventional nipping rollers 47 to flatten and level the spine area after the notching and compress the closed trailing ends of the signatures to the greatest possible extent before the packs 20 pass through the side coat-applying station 48 to have the first coats 35 of hot melt adhesive applied to them.

Figure 11:
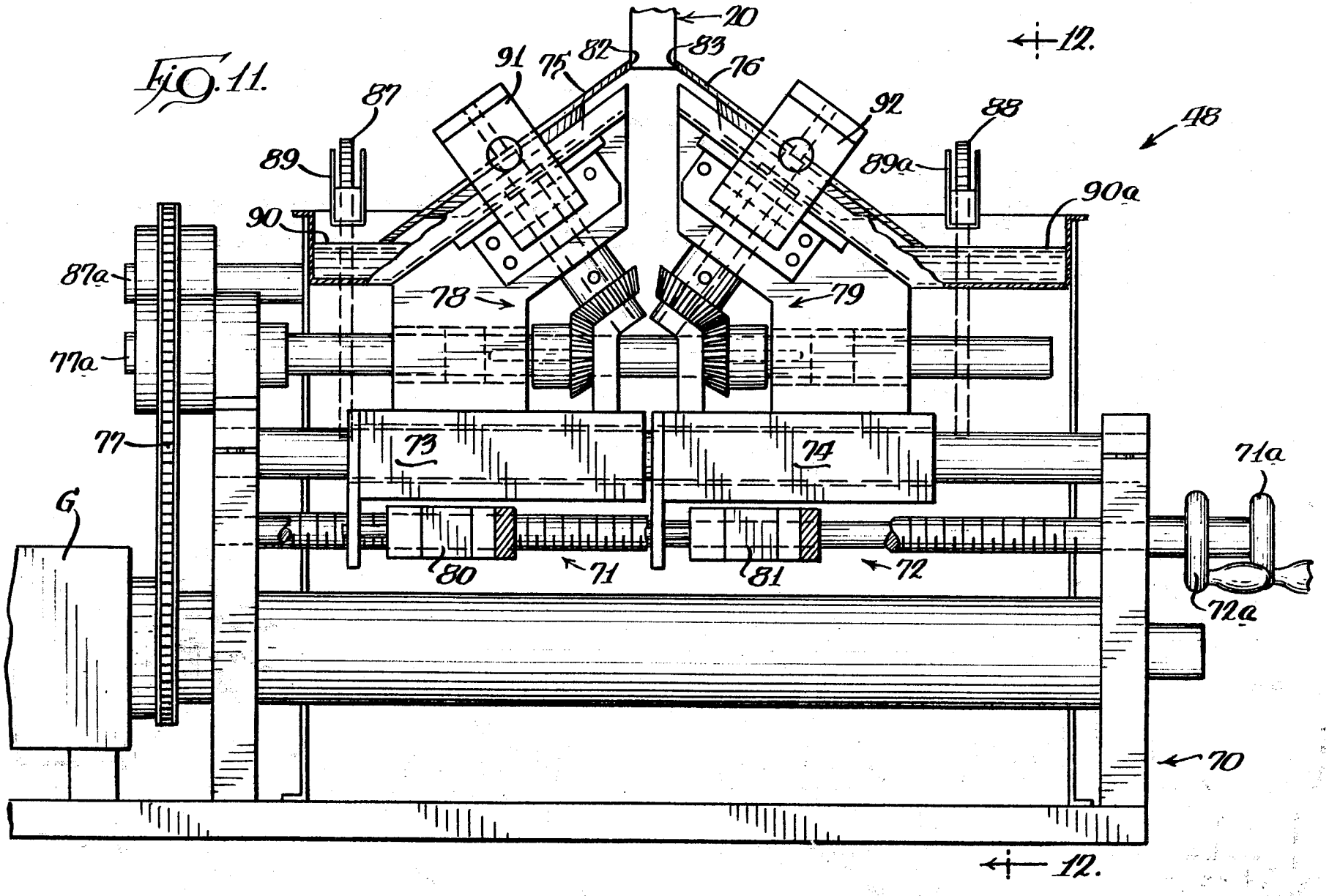
FIG. 11 is a fragmentary sectional view taken substantially as indicated along the line of 11—11 of FIG. 8.

Referring now particularly to FIG. 11, the apparatus in the side coating station 48 consists of a frame 70 which supports a backside adjustable carriage 71 and a frontside adjustable carriage 72 which are below and flank the line of travel of the packs 20. The carriages 71 and 72 are manually adjustable laterally with respect to the centerline of the clamps, by means of hand cranks 71*a* and 72*a* so as to accommodate the side coating apparatus to packs 20 of different thicknesses. The carriages 71 and 72 support respective stripping wheel heads, indicated generally at 73 and 74. The stripping wheel heads 73 and 74 carry respective adhesive strip applicator wheels 75 and 76 which are rotated from the binder shaft through a gear box G, a chain drive 77, and a shaft 77*a* slidably supports and drives respective bevel gear drive systems, indicated generally at 78 and 79.

In order that the space between the strip applicator wheels 75 and 76 may shift slightly during operation to accommodate variations in the thickness of the spine areas of successive packs 20, and also variations in the thickness of each pack due to the fact that each pack has a closed end which is preferably trailing, suitable floating mounts are provided which, in the preferred embodiment, consist of respective back 80 and front 81 air cylinders having about one-quarter inch (6.35 mm) piston travel. The piston of the air cylinder 80 is normally fully retracted and that of the air cylinder 81 is normally fully extended to set the minimum space between the strip applicator wheels 75 and 76 in the particular adjusted position of the heads 73 and 74; and the air cylinder pistons are pushed slightly from their normal positions when thicker signature packs or thicker parts of a single signature pack pass between the strip applicator wheels 75 and 76. A suitable air pressure for the cylinders 80 and 81 is approximately eighty pounds PSIG (about 5.5 $Kg/cm^2$); and the amount the pistons are retracted rarely exceeds about 0.005 inch (0.1375 mm).

Figure 14:
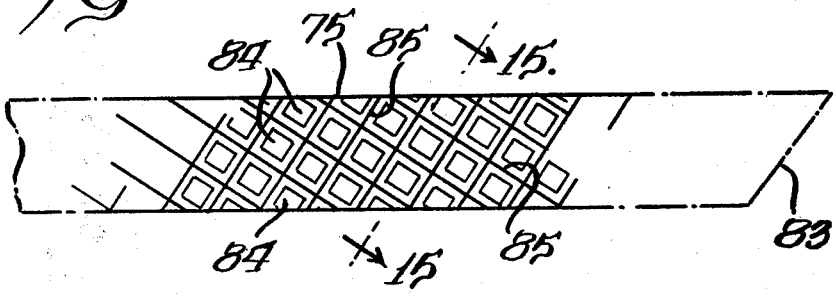
FIG. 14 is an enlarged elevational view of the working surface of one of the glue-applying wheels.
Figure 15:
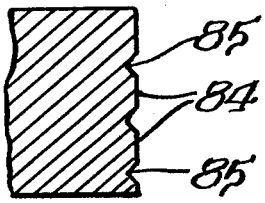
FIG. 15 is a sectional view on an enlarged scale taken substantially as indicated along the line 15—15 of FIG. 14.

Referring now particularly to FIGS. 11, 14 and 15, both wheels 75 and 76 are set at an angle of about 37° to the vertical, and have respective circumferential working surfaces 82 and 83 which are vertical so as to bear flat upon the faces of the pack 20. Each of the peripheral working surfaces 82 and 83 has a pattern of substantially square lands 84 separated by grooves 85, with the points of intersection of the bottoms of the grooves 84 randomly located relative to the circumferential center line of the working surface. Conveniently, the lands and grooves are formed by first cutting a conventional 45° diamond knurl with a pitch length of about 0.07 inch (1.778 mm), and then finishing the surfaces 82 and 83 to remove the tops from the pyramidal knurls and leave a finished groove depth of about 0.015 to 0.020 inch (0.381 to 0.508 mm).

Figure 12:
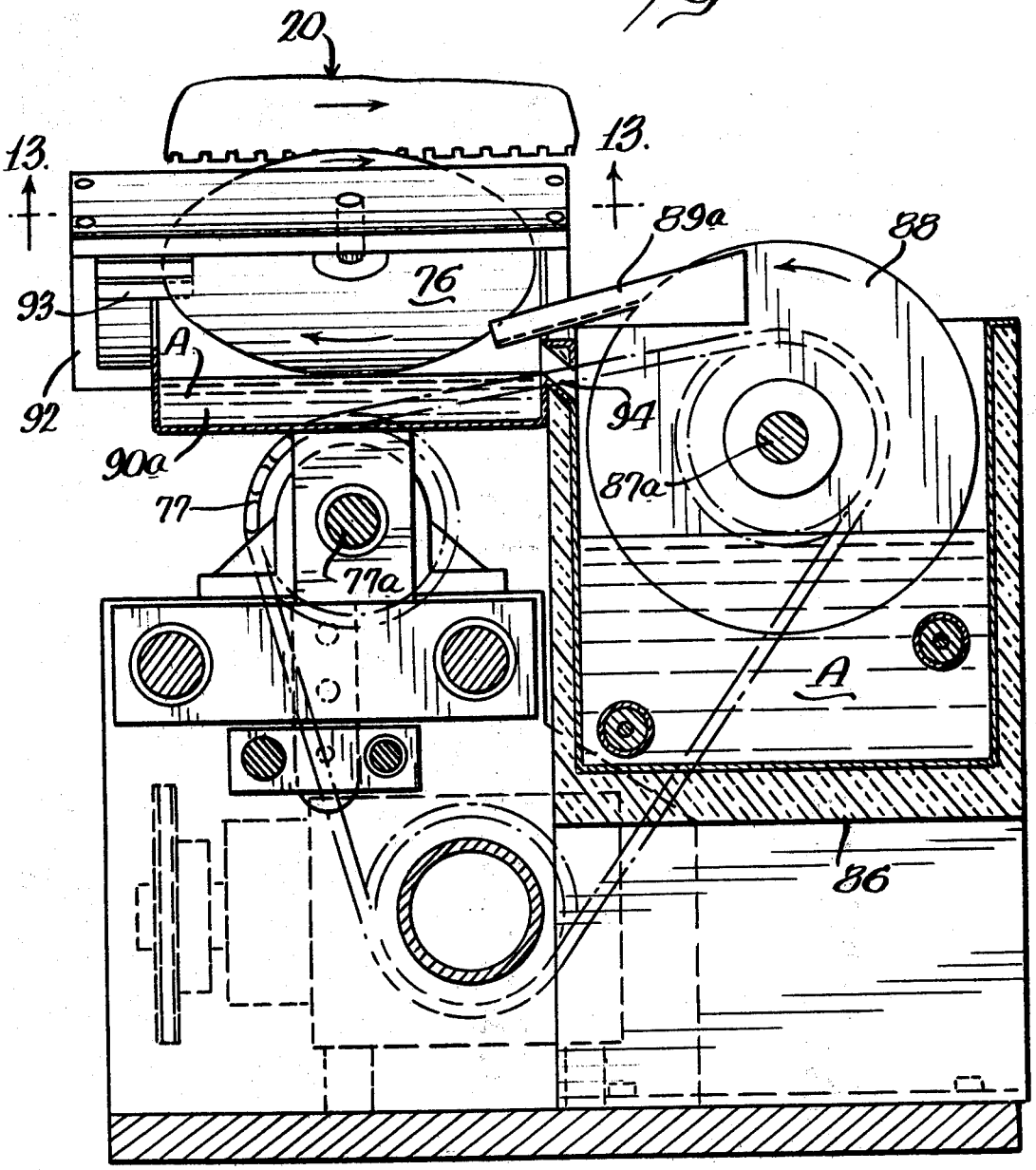
FIG. 12 is a fragmentary sectional view taken substantially as indicated along the line of 12—12 of FIG. 11.

As best seen in FIGS. 11 and 12, extending across the side coat applicator frame 70 is a hot melt adhesive pot 86, and at opposite sides of the pot are slowly rotating respective feed wheels 87 and 88, the surfaces of which pick up the melted adhesive A which is scraped off into respective feed troughs 89 and 89*a*. The adhesive flows into small supply pools 90 and 90*a* and the adhesive is picked up from the supply pools by the working periphery 82 and 83 of the respective strip applicator wheels 75 and 76. The feed wheels 87 and 88 are on a shaft 87*a* which is driven from the gear box G by the chain 77.

Figure 13:
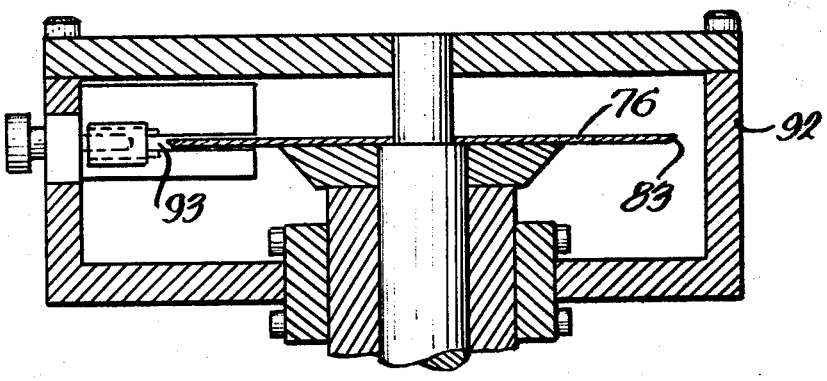
FIG. 13 is a sectional view on an enlarged scale taken substantially as indicated along the line 13—13 of FIG. 12.

Immediately above the supply pools are brackets 91 and 92, each of which supports an adjustable scraper such as the scraper 93 in FIGS. 12 and 13. The scrapers contact the respective working periphery 82 and 83 of the strip applicator wheels to scrape the adhesive from the lands 84 and return it to the adhesive pots through respective return troughs of which one trough 94 is seen in FIG. 12. The strip applicator wheels 75 and 76, therefore, act as metering devices which apply thin coats of hot melt adhesive in a sort of lattice pattern, and the heavy pressure with which the strip applicator wheels bear against the signature packs 20 passing between them enhances the deposit of adhesive in the notches 29 where the adhesive principally piles up against the downstream faces 32 of the notches 29 and also inherently squeezes out the thick bead 35*a* of adhesive along the edge of each adhesive strip above the notches.

As is well known in the art, it is essential when the binding machine is shut down that the hot melt adhesive continue to be circulated so that it does not congeal upon the wheels 75 and 76; and such continuing operation of the side coat applicator 48 may be provided for in any known way, as by a motor which drives the chain drive 77 through a suitable clutch.

From the side coat applicator 48 the packs 20 pass to the station 49 for the spine coat applicator, which is of entirely conventional construction. It includes a hot melt adhesive tank 96 and a driven roller 97 which is wide enough to apply an excess of hot melt adhesive to the entire spine 24 of each pack 30, thus forming the thick coats 36 which amalgamate with the thin side coats 35 to provide the homogeneous finished wrap-around coating 34.

The spine coat applicator also includes the usual spinner (not shown) which removes excess hot melt from the spine coat 36 and returns it to the tank 96; so the back surface of the finished wrap-around coat 34 may be smooth and of a generally uniform thickness.

The hot melt adhesive used in the practice of the present method may be standard commercial formulation of a type that is available from various suppliers.

Typically, such an adhesive consists of ethylene vinyl acetate, a resin ester or a hydrocarbon resin, and a microcrystalline wax or petroleum wax. A hot melt adhesive which has been used in the successful experimental practice of the present method is Fuller's #1538, procurable from H. B. Fuller Co. of St. Paul, Minn.

A typical commercial binding machine used in the practice of the present method operates at a rate of about 150 books per minute. The cost of binding books in accordance with the present method is directly comparable to the cost of conventional perfect binding using a one-shot hot melt adhesive method. The present method requires somewhat more adhesive than is used in conventional perfect binding; but the increased cost of adhesive is approximately balanced by the reduced amount of paper scrap.

Sample books embodying the present invention have been subjected to page flex and page pull tests which are standard in the industry for determining the quantity of the binding in a book. In a page flex test, a sample page from each of the books tested was flexed for one thousand cycles without failure of the binding between that page and the rest of the book. Conventional perfect bound books ordinarily are incapable of undergoing a one-thousand page flex without failure. The tests were conducted on a Plunkett tester which is standard in the industry, and the test procedure was normal.

On a page pull test, a page from each of the books tested withstood a pull of sixty pounds (27 kg) or slightly higher, and in each test the paper failed before the binding failed. The page pulls in pounds are in the same range as would be expected from a perfect bound book made with the same paper. However, it is anticipated that when more exhaustive tests can be run on the books of the present invention, the books will exhibit greater uniformity of page pull from book to book and throughout a book than can be expected with perfect binding.

The foregoing detailed description is given for clearness of understanding only and no unnecessary limitations should be understood therefrom, as modifications will be obvious to those skilled in the art.

I claim:

1. An improved book which is bound and ready to be covered or cased, said book comprising:

a pack of signatures at least some of which comprise a plurality of interleaved sheets, each signature having a closed side along the spine, and said pack having its entire spine and all the closed sides of sheets in each signature penetrated by a multiplicity of closely spaced, wide open notches which greatly enlarge the area of the spine to which adhesive may be applied;

and a wrap-around coating of adhesive which covers the entire spine area including the faces of the notches, the spine between the notches, and the front and back surfaces of the pack between and immediately adjacent the notches, said wrap-around coating of adhesive consisting of thin coats which are on the front and back surfaces of the pack and extend into the notches, each said thin coat having a thick bead along its margin remote from the notches, and a thick coat which is on the faces of the notches and the spine between the notches, said thin coats and said thick coat being amalgamated in the notches.

2. The book of claim 1 which includes front and back end sheets forming parts of the notched packs, said thin coats of adhesive being on said end sheets, and the parts of said thin coats which extend into the notches being also on parts of the signatures.

3. The book of each one of the preceding claims in which the notches have substantially flat bottom faces and parallel end faces.

4. The book of claim 3 in which the notches occupy about one-third of the spine.

5. The book of claim 3 in which the adhesive is a congealed hot melt adhesive.

6. The book of any one of claims 1, 2, 4 or 5 in which the thin coats of adhesive are on the front and back surfaces of the pack in a fine pattern consisting of narrow strips of adhesive interspersed with uncoated areas.

7. The book of claim 6 in which the pattern is generally in the form of a lattice.

8. A method of making a succession of bound books which are ready to be covered or cased, said method comprising the steps of:

(a) in a first step forming a succession of packs consisting of a plurality of signatures and front and back end sheets while moving all said packs endwise in constantly spaced relationship to one another at a constant speed sufficient to produce at least about 100 books a minute, at least some of said signatures comprising a plurality of interleaved sheets, and each signature having a closed side;

(b) in a second step clamping said packs seriatim with said closed sides of the signatures lowermost and copolanar with one another and with the lower margins of the end sheets to provide each pack with a spine, the lower marginal portions of the packs being free of clamping pressure;

(c) in a third step forming a multiplicity of closely spaced, wide open notches seriatim in the spines of said moving packs, said notches penetrating the entire spine and all the closed sides of sheets in each signature to greatly enlarge the area of each spine to which adhesive may be applied;

(d) in a fourth step nipping said lower marginal portions of the moving packs seriatim; and (e) thereafter in separate steps applying thin strips of adhesive simultaneously to each of the front and back surfaces of the moving packs seriatim adjacent and between the notches in such a way that some of said adhesive extends into said notches and some of said adhesive forms a thick bead along the margin of the strip remote from the notches, and applying an excess of adhesive seriatim to the spines of said moving packs in such a way that said adhesive coats the entire spine and the faces of the notches and amalgamates with the adhesive of said thin strips in the notches.

9. A method of making a succession of bound books which are ready to be covered or cased, said method comprising the steps of:

(a) in a first step forming a succession of packs of signatures while moving all said packs endwise in constantly spaced relationship to one another at a constant speed sufficient to produce at least about 100 books a minute, at least some of said signatures comprising a plurality of interleaved sheets, each signature having a closed side;

(b) in a second step clamping said packs seriatim with said closed sides lowermost and coplanar to provide each pack with a spine and with the lower marginal portions of said packs free of clamping pressure;

(c) in a third step forming a multiplicity of closely spaced, wide open notches seriatim in the spines of said moving packs, said notches penetrating the entire spine and all the closed sides of sheets in each signature to greatly enlarged the area of each spine to which adhesive may be applied;

(d) in a fourth step nipping said lower marginal portions of the moving packs seriatim; and (e) thereafter in separate steps applying thin strips of adhesive simultaneously to each of the front and back surfaces of the moving packs seriatim adjacent and between the notches in such a way that some of said adhesive extends into said notches and some of said adhesive forms a thick bead along the margin of the strip remote from the notches, and applying an excess of adhesive seriatim to the spines of said moving packs in such a way that said adhesive coats the entire spine and the faces of the notches and amalgamates with the adhesive of said thin strips in the notches.

10. The book of claim 1 or claim 2 in which the adhesive is a congealed hot melt adhesive.

11. The method of claim 9 in which the strips of adhesive applied to the front and back faces of the packs are rolled onto said faces by rotating members that compress the packs so as to squeeze the adhesive into the notches and pile it up along the downstream faces of the notches, and so as to also squeeze the adhesive out and thus form the beads.

12. The method of claim 11 in which the adhesive is a hot melt.

13. The method of claim 9 or claim 8 in which the thin strips of adhesive are applied to the front and back surfaces in a fine pattern consisting of narrow strips of adhesive interspersed with uncoated areas.

14. The method of claim 13 in which the pattern is generally in the form of a lattice.

15. The method of claim 8 in which the strips of adhesive applied to the front and back faces of the packs are rolled onto said faces by rotating members that compress the packs so as to squeeze the adhesive into the notches and pile it up along the downstream faces of the notches, and so as to also squeeze the adhesive out and thus form the beads.

16. The method of claim 9 or claim 8 in which the step of applying thin strips of adhesive to the front and back surfaces of the moving packs precedes the step of applying an excess of adhesive to the spines of said moving packs.

17. The method of claim 16 in which the thin strips of adhesive are applied to the front and back surfaces in a fine pattern consisting of narrow strips of adhesive interspersed with uncoated areas.

18. The method of claim 17 in which the pattern is generally in the form of a lattice.

19. The method of claim 15 in which the adhesive is a hot melt.

* * * * *